US006471343B1

(12) United States Patent
Shimizu et al.

(10) Patent No.: US 6,471,343 B1
(45) Date of Patent: Oct. 29, 2002

(54) INK SUPPLY SYSTEM AND INK JET RECORDING APPARATUS

(75) Inventors: Eiichiro Shimizu, Yokohama (JP); Shozo Hattori, Tokyo (JP); Hajime Yamamoto, Yokohama (JP); Hiroshi Koshikawa, Kawasaki (JP); Hiroki Hayashi, Kawasaki (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/599,588

(22) Filed: Jun. 22, 2000

(30) Foreign Application Priority Data

Jun. 24, 1999 (JP) ..... 11-178573

(51) Int. Cl.[7] ..... B41J 2/175
(52) U.S. Cl. ..... 347/85
(58) Field of Search ..... 347/85, 86, 87; 220/495.01, 495.07

(56) References Cited

U.S. PATENT DOCUMENTS 4,558,326 A * 12/1985 Kimura et al. ..... 347/30
5,435,452 A * 7/1995 Nishigami et al. ..... 215/12.1
5,509,140 A * 4/1996 Koitabashi et al. ..... 347/86
5,745,137 A * 4/1998 Scheffelin et al. ..... 347/85
5,992,990 A * 11/1999 Childers et al. ..... 347/87
6,315,402 B1 * 11/2001 Kawase ..... 347/85
6,345,888 B1 * 2/2002 Matsumoto et al. ..... 347/86

FOREIGN PATENT DOCUMENTS

EP 738 605 * 10/1996

* cited by examiner

*Primary Examiner*—Michael Nghiem
(74) *Attorney, Agent, or Firm*—Fitzpatrick, Cella, Harper & Scinto

(57) ABSTRACT

An ink supply system which includes an ink jet head for discharging ink and an ink tank retaining ink to be supplied to the ink jet head through a passage. A negative pressure generating container is provided along the passage, and generates negative pressure by a restoring force at the time of being deformed. With the ink supply system thus structured, it becomes possible to perform stable recording, because the fluctuation of flow resistance due to the fluctuation of discharge amount is made smaller, and also, there is almost no fluctuation of pressure along the carriage operation. Also, the retaining amount of ink becomes suitably greater for the performance of higher speed printing, and the replacement of ink tanks is possible, while ink still remains in the negative pressure generating container, hence making it possible to essentially prevent a complete ink depletion.

4 Claims, 13 Drawing Sheets

INK SUPPLY SYSTEM AND INK JET RECORDING APPARATUS

BACKGROUND OF THE INVENTION

1. Field of the Invention

The present invention relates to an ink supply system utilized for an ink jet recording apparatus or the like, and also, an ink jet recording apparatus. More particularly, the invention relates to an ink supply system a part of ink container of which is replaceable, and to an ink jet recording apparatus as well.

2. Related Background Art

An ink jet recording apparatus is the one that records by discharge ink from recording means (an ink jet head) to a recording medium, which has been widely used in recent years owing to the advantages, among some others, that the recording means can be made compactly with ease; the amount of noises is smaller with the adoption of non-impact method; and color images can be made easily with the capability to use various kinds of ink in many ways.

As the ink supply system used for the ink jet recording apparatus, there has conventionally been known the one which is detachably mounted on a carriage that carries an ink jet head, and an ink tank connected and communicated with the ink jet head. Here, an ink absorbent having ink absorbed and retained in it in advance is filled in the ink tank, thus making it possible to supply ink retained in the ink absorbent to the ink jet head. For an ink supply system of the kind, it is generally practiced to arrange the structure so that an ink absorbent formed by a porous substance, such as polyurethane form, is filled in the housing of an ink tank, and then, a tank cover is welded to it. With the structure thus arranged, there is an advantage that ink is retained stably in the ink tank irrespective of movement or vibration given to it.

However, along with the higher speeds required for an ink jet recording apparatus in recent years, it becomes necessary to supply ink to the head in a larger amount at a shorter period of time. As a result, the amount of ink to be used becomes more increasingly, while the ink supply system described above has the ink absorbent filled almost entirely in the interior of the ink tank. Therefore, the amount of retainable ink is naturally limited only to the capacity of the absorbent that may be contained in the tank. The resultant amount of ink that can be injected becomes considerably smaller against the volume of the ink tank as compared with the ink supply system which is structured to allow ink to be injected up to an amount almost equally to the total volume of an ink tank having no ink absorbent in it.

Also, the capillary member, such as porous substance, tends to increase the flow resistance along the supply amount of ink. In addition, the flow resistance changes depending on the printing duty. As a result, the negative pressure exerted on the head orifices is caused to change greatly. Then, there is a fear that this makes the fluctuation of discharge amount greater. Also, the higher quality of images and the multiple use of ink are more in demand so that a slight change of ink composition may influence the finish of recorded images inevitably. In other words, the capillary member, such as porous substance, has a large surface area (liquid contact area with ink), and it is required for this member to provide a rigid chemical stability so that no decomposition nor elution should occur when it is in contact with ink. Thus, the selection of material usable as porous substance is automatically limited in consideration of reactive binding, physical adsorption, or the like.

SUMMARY OF THE INVENTION

With a view to solving the problems discussed above, the present invention is designed. It is an object of the invention to provide an ink supply system which comprises an ink jet head for discharging ink; and a negative pressure generating container provided for a passage capable of distributing ink, including an ink tank retaining ink to be supplied to the ink jet head, and generating negative pressure by means of restoring force at the time of being deformed.

In accordance with the present invention, it is possible to perform stable recording, because the fluctuation of flow resistance due to the fluctuation of discharge amount is made smaller, and also, there is almost no fluctuation of pressure along the carriage operation. Therefore, the retaining amount of ink becomes suitably greater for the performance of higher speed printing. Moreover, the replacement of ink tanks is possible, while ink still remains in the negative pressure container, hence making it possible to prevent the complete ink shortage essentially. Also, with the smaller liquid contact area of the member that should be in contact with ink, the range of material selection becomes wider for such member.

Here, the ink jet head may be arranged for one end portion of the passage capable of distributing ink. Also, it may be possible to arrange the ink tank for the other end portion of the passage capable of distributing ink, and to enable the negative pressure generating container to lie between the ink jet head and the ink tank.

Or, it may be possible to arrange the negative pressure generating container for the other end portion of the passage capable of distributing ink, and between the ink jet head and the ink tank. In this case, it becomes possible to allow the negative pressure generating container which is positioned on the other end portion to function as a buffer tank, thus absorbing the fluctuation of pressure due to changes of the atmospheric pressure or temperature in order to suppress the influence that may be exerted on ink discharges.

Also, the negative pressure generating container may be a container formed by multiple layers, and provided with outer layer forming a housing of substantially polyhedral column shape, and an inner bag arranged inside the outer layer correspondingly, being capable of retaining ink therein and elastically deformable along the lead-out of ink.

Here, the inner bag may be provided with an air escape port on the upper part thereof, and the inner bag may be formed by material having low gas permeability.

The negative pressure generating container may be a container formed by multiple layers, and the outermost layer is a housing of substantially polyhedral column shape, and the innermost layer is an elastically deformable inner bag formed by material having high gas permeability, and ink can be retained in a space between the housing and the inner bag.

The negative pressure generating container may be a container formed by multiple layers, and the outermost layer is a substantially tubular shape, and the innermost layer is structured to provide inner walls being capable of distributing ink and elastically deformable along the lead-out of the ink, and one or more of the containers are continuously connected. In this case, it becomes possible to make an ink jet recording apparatus smaller as a whole.

The negative pressure generating container may be a container formed by multiple layers, and the outermost layer is a housing of substantially polyhedral column shape, and the innermost layer is in either one of modes of having an inner bag being capable of distributing ink and elastically deformable along the lead-out of the; having an ink containing chamber for retaining ink, and a buffer chamber separated from the ink containing chamber by a partition wall, but communicated therewith through a communicating portion; and having an ink containing bag in a housing. In this case, the effect is made higher on the ink leakage. Also, since the ink tank is provided itself with the function to generate negative pressure, there is no restriction imposed upon the position of the ink tank to make miniaturization possible for an ink jet recording apparatus, as well as to enhance the freedom of planning and designing thereof. Also, by means of multiple layer blow molding or the like, manufacture becomes possible with one molding process simply at lower costs.

Also, with the ink tank, there may be further connected a buffer container structured with multiple layers, having the outermost layer thereof being a housing of substantially polyhedral column shape, and the innermost layer being inner walls elastically deformable by the environmental changes.

The negative pressure generating container may be gas-liquid separation means capable of transmitting to the outside the gas existing in ink retained in a container. Then, the gas-liquid separation means may comprise an inner bag having high gas permeability for constituting the negative pressure generating container, and pressure reduction means connected with the negative pressure generating container.

A space may be provided for the interface between the housing and inner bag to constitute the negative pressure generating container, and pressure generating means is connected with the space.

The pressure generating means may be means for reducing pressure against the atmospheric pressure.

The inner bag may be formed by material having high gas permeability.

The pressure generating means may be means for applying pressure to the atmospheric pressure.

The ink jet recording apparatus of the present invention is provided with an ink supply system having either one of the structures described above.

DETAILED DESCRIPTION OF THE PREFERRED EMBODIMENTS (First Embodiment)

Now, hereinafter, with reference to the accompanying drawings, the embodiments will be described in accordance with the present invention.

Figure 1:
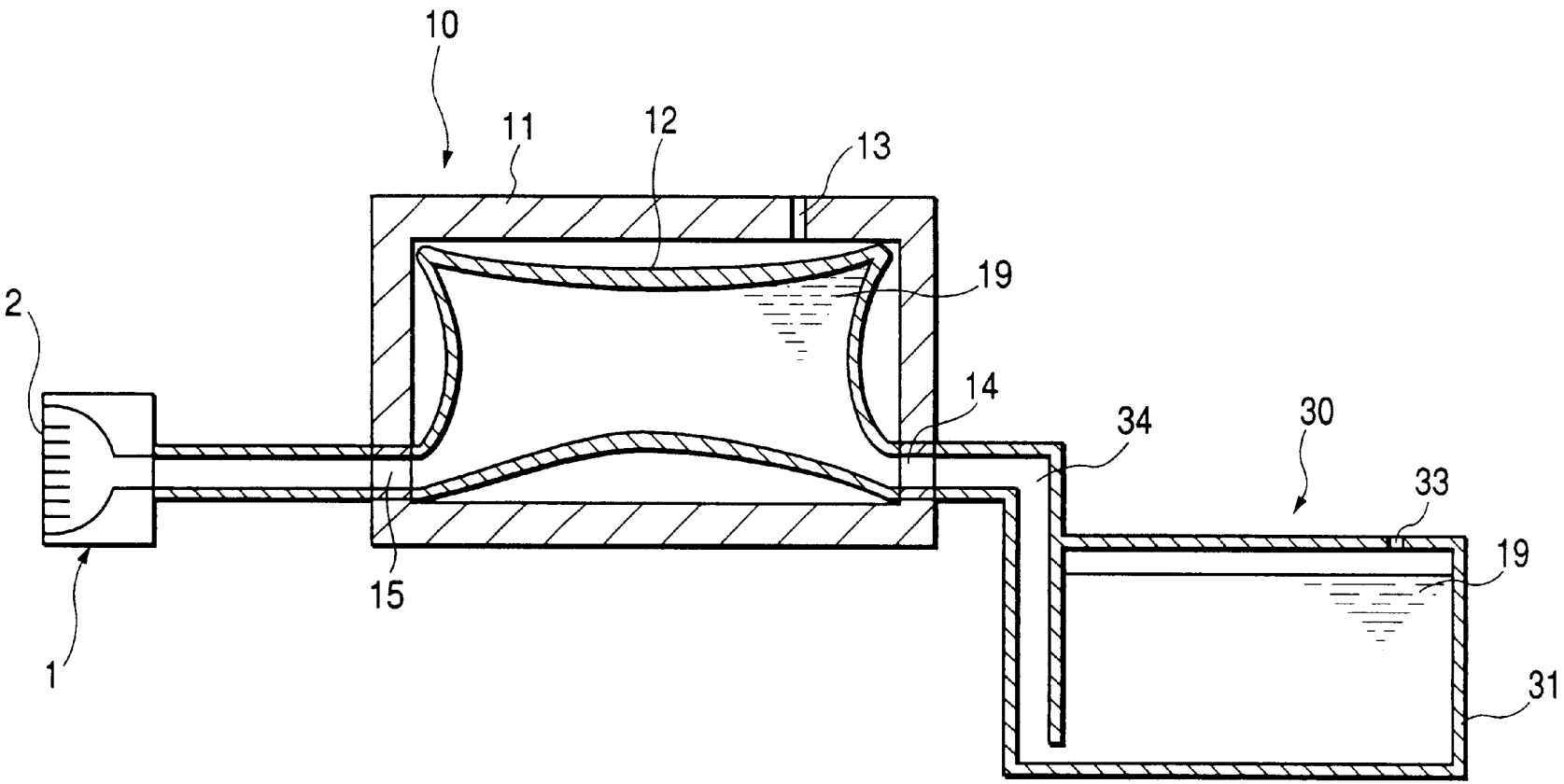
FIG. 1 is a view which schematically shows an ink supply system in accordance with a first embodiment of the present invention.

FIG. 1 is a cross-sectional view which shows schematically an ink supply system in accordance with a first embodiment of the present invention. For the present embodiment, the passage that makes ink distribution possible comprises an ink jet head 1 that records by discharging ink from ink discharge ports 2, and an ink tank 30 which is connected with the ink jet head 1 through a negative pressure generating container 10 to supply ink to the head.

The negative pressure generating container 10 comprises a housing 11, and an inner bag 12 positioned on the inner side of the housing 11, which can be peeled off from the housing 11. The negative pressure generating container 10 is provided with the ink supply port 15 through which ink is supplied to the ink jet head 1, and the ink suction port 14 through which ink 19 in the ink tank 30 is sucked into the negative pressure generating container 10. In other words, the negative pressure generating container 10 is connected with the ink jet head 1 through the ink supply port 15, and connected with the ink tank 30 through the ink suction port 14 and the ink supply tube 34 which will be described later. In the interior of the inner bag 12, ink 19 is retained. On a part of the housing 11, the atmospheric communication port 13 is arranged to enable the space between the housing 11 and the inner bag 12 to be communicated with the air outside.

The negative pressure generating container 10 is a hollow container of almost polyhedral column, which has function to generate negative pressure. The negative pressure generating container 10 is formed by the housing 11 and the inner bag 12, and the housing 11 and the inner bag 12 are made to be peeled off from each other. The inner bag 12 is flexible. This inner bag 12 is made deformable along the lead-out of ink contained in it. Also, the atmospheric communication port 13 is provided therefor, and the air outside can be induced into the gap between the inner bag 12 and the housing 11 through the atmospheric communication port 13.

The inner bag 12 is formed by laminating three layers, a liquid contact layer having resistance to ink, a layer to govern elastic modulus, and a gas barrier layer excellent in gas barrier capability, in that order from the inner side. Each of the layers is conditioned to be in contact, but separated by each function assigned to each of them accordingly. The layer to govern elastic modulus is the one to keep the elastic modulus of this layer almost constantly within a range of use temperatures of the negative pressure container. In other words, the elastic modulus of the inner bag 12 is kept almost constantly by the layer to govern elastic modulus within a range of use temperatures of the negative pressure generating container 10. For the inner bag 12, it may be possible to replace the intermediate layer with the outer layer, and the layer to govern elastic modulus is made the outermost layer, and the gas barrier layer is made the intermediate layer without any problem.

With the inner bag 12 thus structured, it becomes possible for the inner bag 12 to demonstrate the function of each layer sufficiently by means of a small layer structure, such as the ink resistance layer, the layer to govern elastic modulus, and the gas barrier layer. The influence that may be exerted by the temperature changes on the elastic modulus of the inner bag 12 or the like becomes smaller. Also, for the inner bag 12, the negative pressure is controlled for the negative pressure generating container 10 within the range of use temperatures. Therefore, the elastic modulus is secured suitably to enable the inner bag 12 to function as buffer with respect to ink in the negative pressure generating container 10.

In accordance with the present embodiment, polypropylene is used as the material for the liquid contact layer which is the innermost layer that forms the inner bag 12, ring olefin copolymer is used as the material for the intermediate layer to govern elastic modulus, and EVOH (saponified EVA—ethylene acetic vinyl copolymeric resin) is used as the material for gas barrier layer on the outermost side. Here, it is preferable to contain functional bonding resin material in the layer to govern elastic modulus. Then, it becomes unnecessary to provide any particular bonding layer between each of the interlayers, hence making the thickness of the inner bag 12 smaller.

As the material of the housing 11, polypropylene is used in the case of the innermost layer of the inner bag 12.

With the ink suction port 14, the ink tank 30 is detachably connected through the ink supply tube 34. Ink 19 is contained inside the ink tank 30, and the atmospheric communication port 33 is arranged for the upper portion of the ink tank 30 of the housing 31 to enable the interior of the ink tank 30 to be communicated wit the air outside. The ink tank 30 is arranged on the position where the liquid surface of ink 19 in use is made lower with respect to the negative pressure generating container 10. The leading end of the ink supply tube 34 is arranged on the bottom face of the ink tank 30.

Here, the operation of the present embodiment will be described.

When ink is discharged from the ink jet head 1 mounted on the carriage to scan for recording, ink 19 in the negative pressure generating container 10 is supplied to the ink jet head 1 as ink is being consumed. With the consumption thereof that advances, the inner bag 12 is gradually collapsed, while the restoring force of the inner bag 12 becomes larger gradually. In other words, the negative pressure that acts upon the ink jet head 1 becomes greater gradually. When this negative pressure becomes more than the height difference between the negative pressure generating container 10 and the liquid surface of ink 19 in the ink tank 30, ink in the ink tank 30 is induced into the negative pressure generating container 10. When reaching this state, that is, when ink 19 in the ink tank 30 begins to be induced into the negative pressure generating container 10, the deformation (collapsing) of the bag 12 is not made any longer, and the restoring force of the inner bag 12 becomes constant. Then, the negative pressure is maintained for the ink jet head 1 constantly without any changes substantially until ink 19 in the ink tank 30 is completely consumed.

For the structure thus arranged, any member that generates capillary force is not adopted as negative pressure generating means, with the result that the following effects are demonstrated:

Since the ink supply passage can be made sufficiently thick to suppress the fluctuation of discharge amount, the flow resistance becomes smaller accordingly. In other words, the fluctuation of negative pressure due to the difference in printing duties to make it possible to stabilize printing. Also, it becomes easier to meet the requirement of the higher speed of printing. In addition, as compared with the capillary force generating member, the liquid contact surface of the member which should be in contact with ink (the inner bag) becomes significantly smaller to minimize the unfavorable influence, such as deterioration of ink, among some others. No physical adsorption occurs, either, hence obtaining highly reliable prints stably.

Also, the inner bag 12 absorbs the swinging of ink 19 in the negative pressure generating container 10. As a result, there is almost no fluctuation of negative pressure given to the ink jet head along with the operation of the carriage.

With the structure thus arranged, ink in the ink tank 30 is emptied earlier than ink in the negative pressure generating container 10. Therefore, if the user replaces ink tanks 30 when the ink tank 30 in use is emptied, ink can be replenished, while ink still remains in the negative pressure generating container 10. Thus, there is essentially no ink shortage as a whole.

The ink tank 30 can be mounted on a carriage (not shown) or arranged outside the carriage. If the ink tank 30 is arranged outside the carriage, the structure may be arranged to connect the ink tank with the negative pressure generating container 10 through a tube at all times or it may be possible to adopt the structure (pit-in type) where the negative pressure generating container 10 is connected with the carriage whenever the carriage arrives in the connecting position. In the case of the pit-in type, a valve mechanism (not shown) should be provided in the vicinity of the ink suction port 14 in order to airtightly close the inner bag of the negative pressure generating container 10 when the ink tank 30 is removed. In this respect, these methods for arranging the ink tank are equally applicable to all the embodiments given below.

(Second Embodiment)

Figure 2:
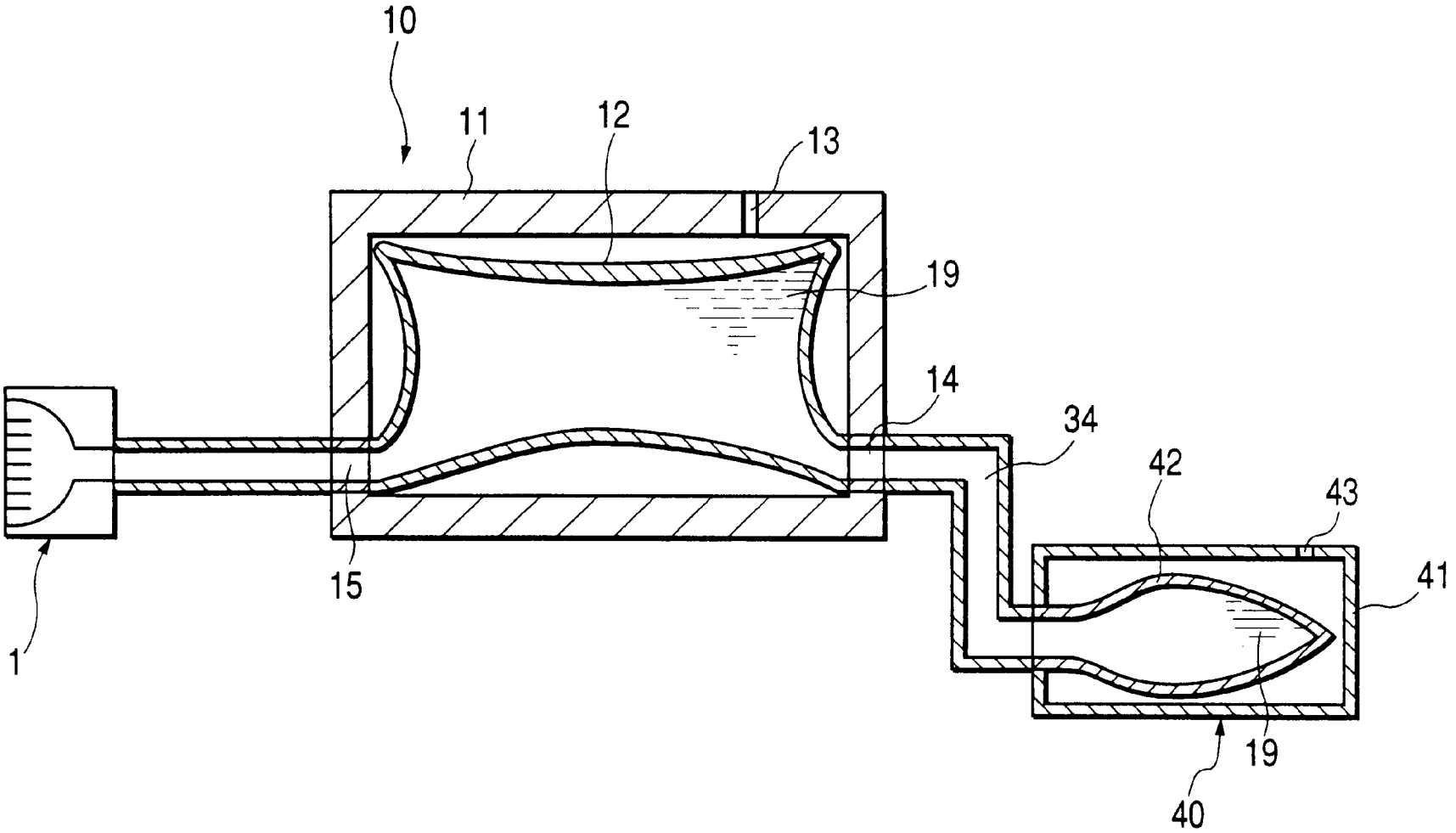
FIG. 2 is a view which schematically shows an ink supply system in accordance with a second embodiment of the present invention.

FIG. 2 is a cross-sectional view which shows schematically an ink supply system in accordance with a second embodiment of the present invention. The structures of the ink jet head 1 up to the negative pressure container 10 are the same as those of the first embodiment, hence applying the same reference marks to them, but the description thereof will be omitted. What differs from the first embodiment is that the mode of the ink tank which is connected with the negative pressure generating container 10 through the ink suction port 14. For the present embodiment, the ink tank 40 comprises a housing 41, and an inner bag 42 that retains ink in it and arranged in the housing 41. An atmospheric communication port 43 is provided for a part of the housing 41. Then, the structure is arranged so that the ink bag 42 is freely collapsed along with the consumption of ink. The ink supply operation to the negative pressure generating container 10 is the same as the first embodiment.

In accordance with the present embodiment, it becomes possible to demonstrate an effect that a highly reliable ink supply system is obtainable against ink leakage, because ink is retained in the ink bag 42 which is housed in the ink tank 40, in addition to the effects obtainable by the first embodiment.

(Third Embodiment)

Figure 3:
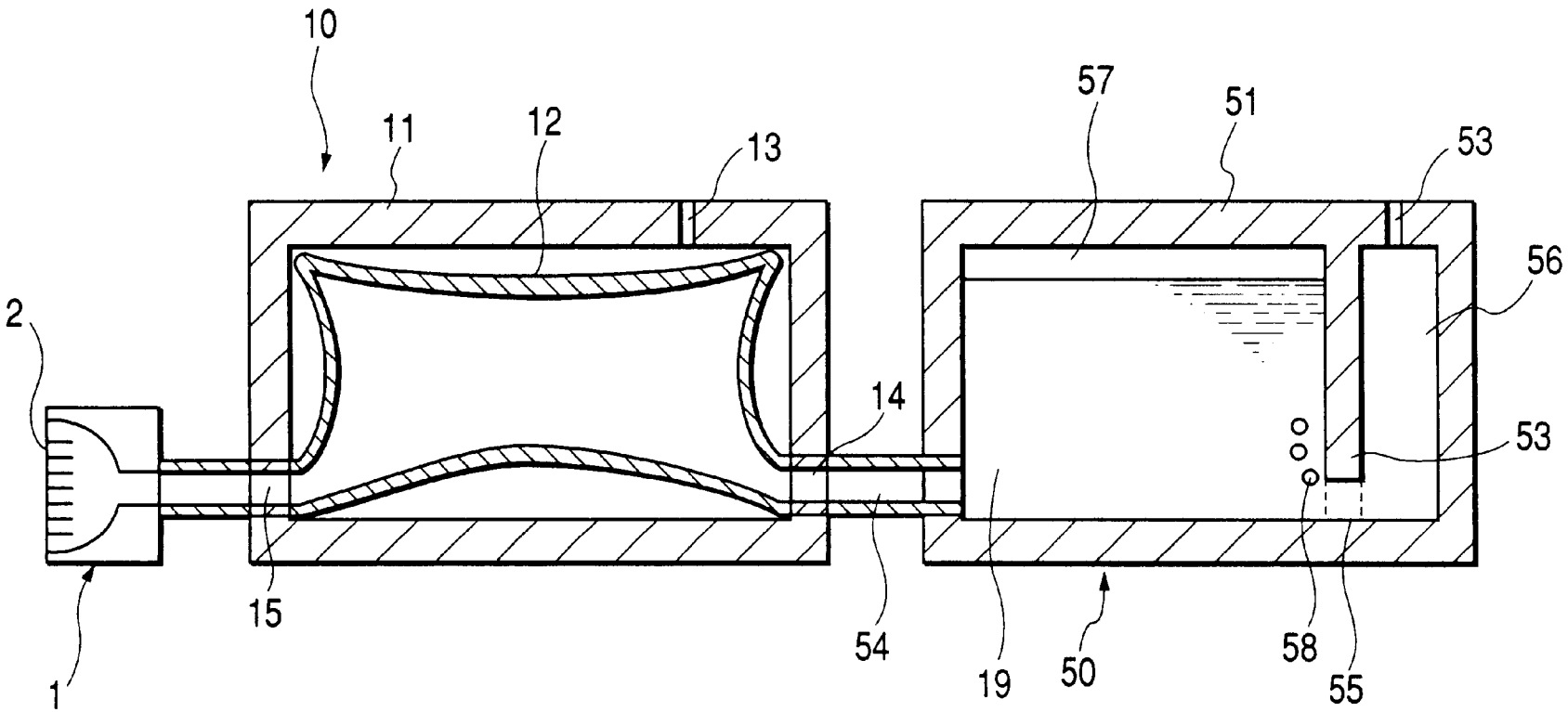
FIG. 3 is a view which schematically shows an ink supply system in accordance with a third embodiment of the present invention.

FIG. 3 is a cross-sectional view which shows schematically an ink supply system in accordance with a third embodiment of the present invention. The structures of the ink jet head 1 up to the negative pressure container 10 are the same as those of the first embodiment, hence applying the same reference marks to them, but the description thereof will be omitted. What differs from the first embodiment lies in the ink tank which is connected with the negative pressure generating container 10 through the ink suction port 14.

The ink tank 50 comprises an ink containing chamber 57 and a buffer chamber 56 divided by use of a partition wall 52. The ink containing chamber 57 is connected with the negative pressure generating container 10, through the ink supply tube 54 and at the same time, it is communicated with the buffer camber 56 in the vicinity of the bottom portion of the ink tank. A capillary member 55 is arranged for the communication portion.

Along with ink consumption, the negative pressure in the negative pressure container 10 becomes higher to ink 59 in the ink tank 50 is induced into the negative pressure generating container 10 through the ink suction portion 14. The negative pressure in the ink containing chamber 57 of the ink tank 50, which is essentially closed, becomes higher along with the lead-out of ink, and against the capillary force (ink meniscus) of the capillary member 55, the air (bubbles) 58 is induced from the atmospheric communication port 53 by way of the capillary member 55 into the ink containing chamber 57 in an amount which matches with the amount of ink thus led out. The structure is arranged so that this operation is repeated, and that ink tanks 50 are replaced when ink the ink tank 50 is completely consumed.

In accordance with the present embodiment, it becomes possible to demonstrate the following effects in addition to those of the first embodiment, because the ink tank 50 is provided itself with negative presser. In other words, in accordance with the first and second embodiment, the replaceable ink tanks 30 and 40 are not provided with negative pressure generating means. Then, whereas there is a restriction that the ink tanks 30 and 40 should be arranged lower than the negative generating container 10, the present embodiment makes it possible to eliminate such restriction imposed upon the position of the ink tank 50, because the ink tank 50 is provided itself with the negative pressure generating means. As a result, an ink jet recording apparatus can be miniaturized more, the planning can be attempted more freely, and the freedom of design is enhanced accordingly.

(Fourth Embodiment)

Figure 4:
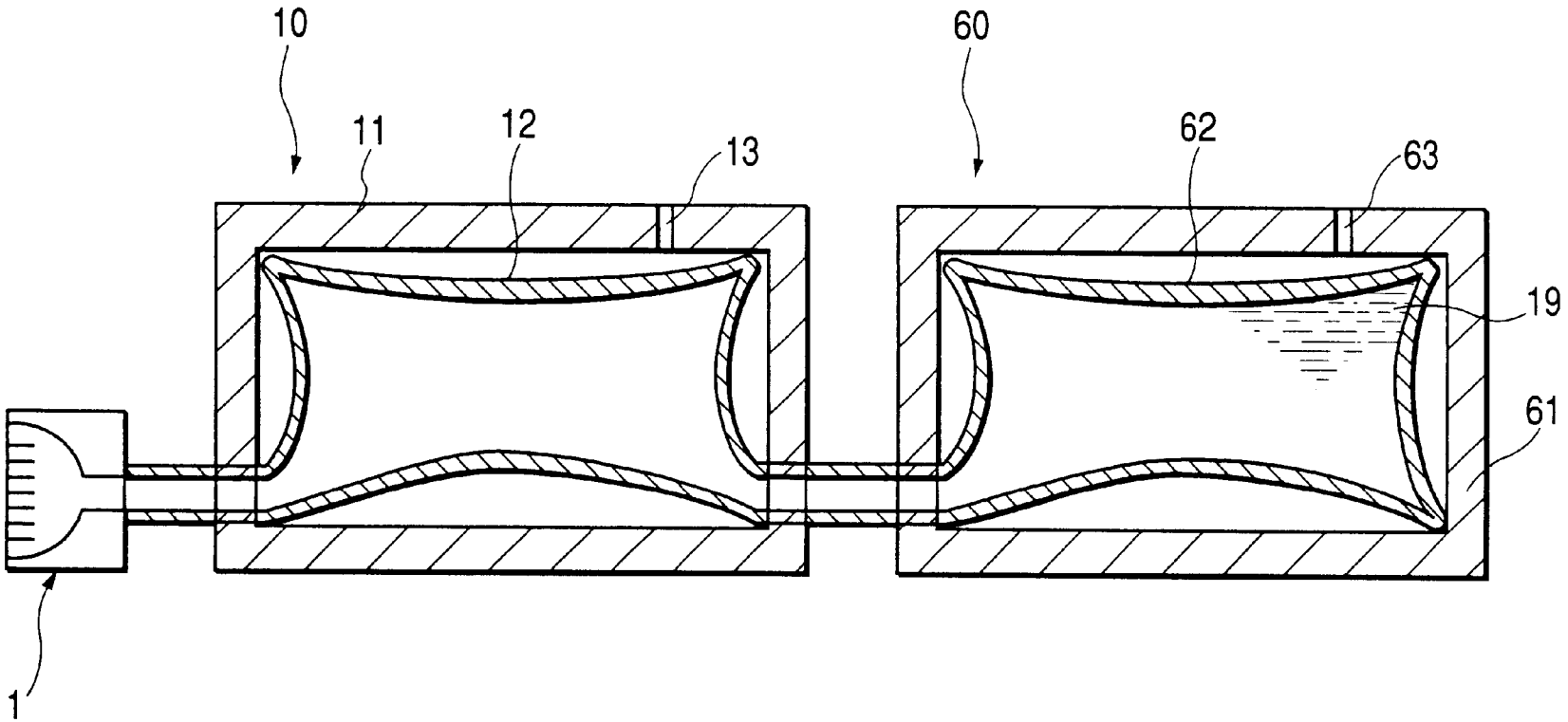
FIG. 4 is a view which schematically shows an ink supply system in accordance with a fourth embodiment of the present invention

FIG. 4 is a cross-sectional view which shows schematically an ink supply system in accordance with a fourth embodiment of the present invention. The same reference marks are applied to the same structures as those appearing in the previous embodiments, and the description will be omitted. The ink tank 60 of the present embodiment comprises a housing 61, and an inner bag 62 having ink retained in it. In the same manner as to the negative pressure generating container 10, an atmospheric communication port 63 is provided for a part of the housing 61 to communicate the housing 61 and the inner bag 62 with the air outside. As for the negative pressure generating container 10, the structure is arranged for the ink tank 60 so that the inner bag 62 is collapsed along with the ink consumption, and that negative pressure is generated in the ink tank 60 by the restoring force of the inner bag 62. Therefore, it is possible to obtain the same effect as the third embodiment with the aspect that the ink tank, which is connected with the negative pressure generating container 10, is provided itself with the source to generate negative pressure. Then, in accordance with the present embodiment, it is possible to mold the ink tank 60 simple by one molding process using a multi-layered blow molding or the like, in addition to the effects which are obtainable from the first and third embodiments, yet there is no need for the provision of any separate port, such as the capillary member required to structure the third embodiment. There is an effect that the costs of manufacture can be reduced accordingly.

The restoring force of the inner bag 62 of the ink tank 60 is made weaker than the restoring force of the inner bag 12 of the negative pressure generating container 10. In other words, it is set to generate higher negative pressure in the negative pressure generating container 10 than in the ink tank 60. In this way, ink in the ink tank 60 is emptied earlier than ink in the negative pressure generating container 10. Therefore, if the user replaces ink tanks 60 when the ink tank 60 in use is emptied, ink can be replenished, while ink still remains in the negative pressure generating container 10. Then, more preferably, there is essentially no ink shortage as a whole.

(Fifth Embodiment)

Figure 5:
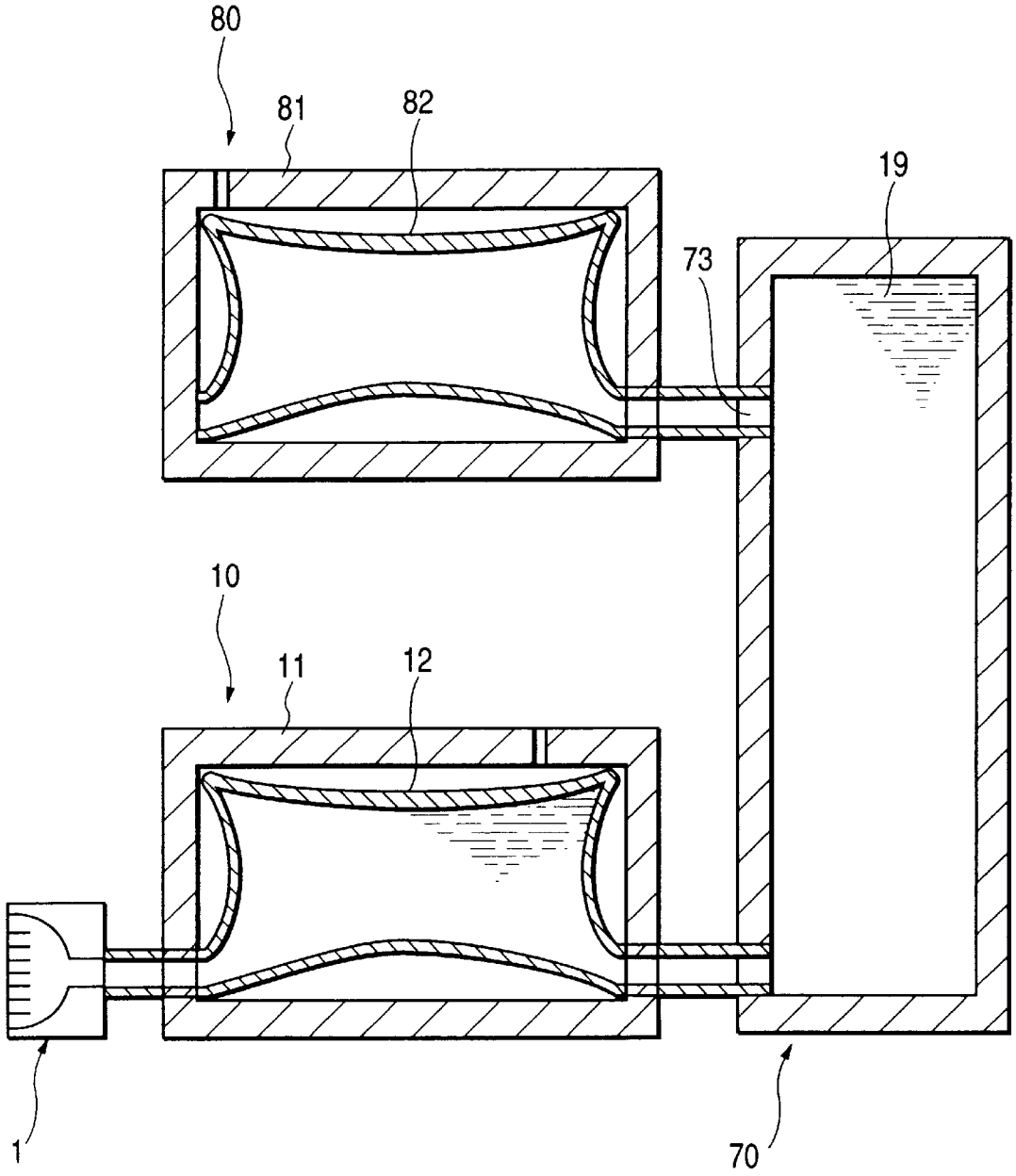
FIG. 5 is a view which schematically shows an ink supply system in accordance with a fifth embodiment of the present invention.

FIG. 5 shows a fifth embodiment. The same reference marks are applied to the same structures as those appearing in each of the previous embodiments, and the description thereof will be omitted. In accordance with the present embodiment, two negative generating containers 10 and 80 are provided. The negative pressure generating container 10 comprises a housing 11 and an inner bag 12 as in the first to fourth embodiments, which is arranged between an ink tank 70 and an ink jet head 1. The other negative pressure generating container 80 also comprises a housing 11 and an inner bag 82, and structured to generate negative pressure by means of the restoring force of the inner bag 82. The negative pressure generating container 80 is a buffer tank connected only with the ink tank 70 which is essentially closed with ink retained in it. This container is not connected with the ink jet head 1 directly. In other words, the structure is arranged so that the ink tank 70 is detachably connected with the ink jet head 1 through the negative pressure generating container 10 on one hand, and connected likewise with the negative pressure generating container 80 on the other.

In the inner bag 82 of the negative pressure generating container 80, the air exists to function as buffer when environment changes (the atmospheric pressure and temperature are caused to change). In other words, if pressure is reduced, the inner bag 82 expands, and if pressure is added, it is collapsed, thus absorbing the changes of pressure in the ink supply system. Also, if, for example, environment changes at the time of ink being filled in the ink tank 70, there is a possibility that ink in the ink tank 70 is allowed to flow into the inner bag 82 through the connecting port 73. However, in accordance with the present embodiment, ink returns to the interior of ink tank 70 promptly along with the ink consumption, and the amount of usable ink is not reduced. Here, this embodiment can of course demonstrate the effects obtainable by the first embodiment.

(Sixth Embodiment)

Figure 6A:
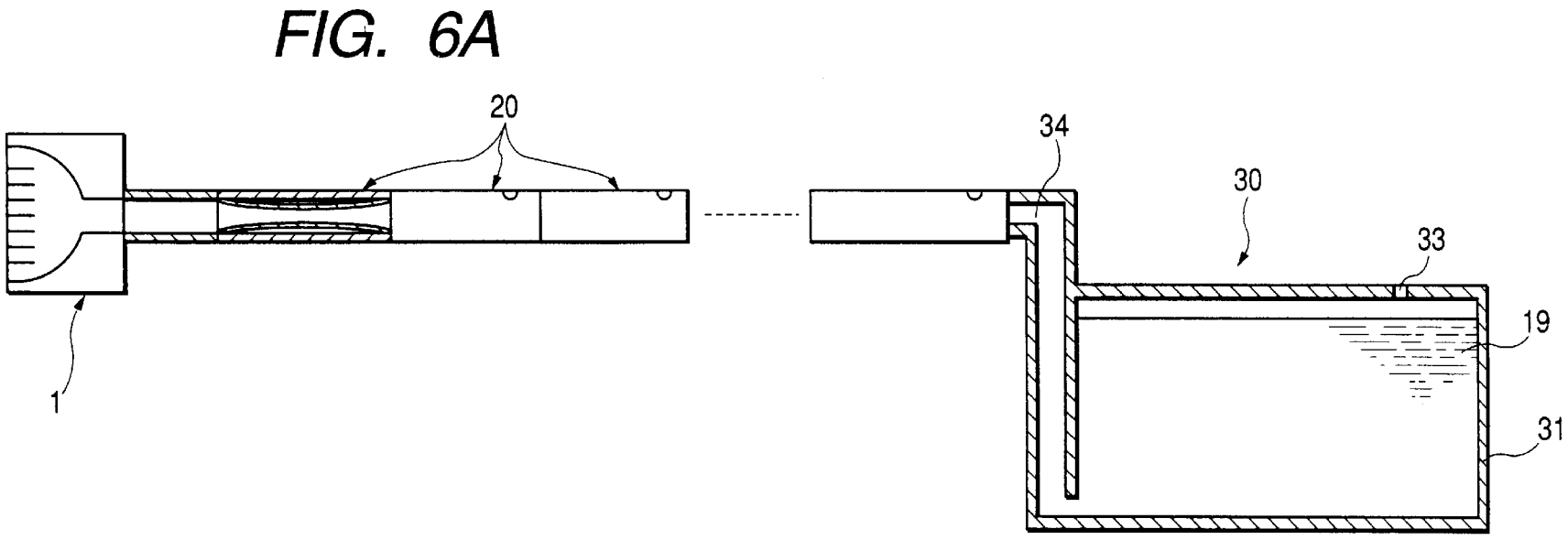
FIGS. 6A, 6B, and 6C are views which schematically illustrate an ink supply system in accordance with a sixth embodiment of the present invention.
Figure 6B:
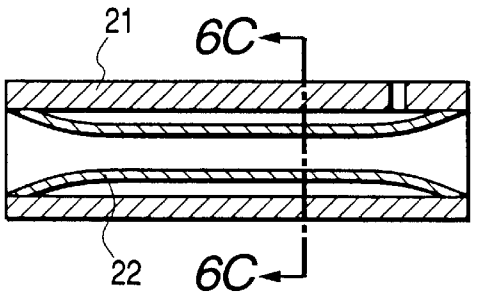
Figure 6C:
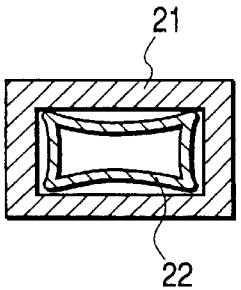

FIGS. 6A, 6B, and 6C are views which illustrate a sixth embodiment. The same reference marks are applied to the same structures as those appearing in each of the previous embodiments, and the description thereof will be omitted. The negative pressure generating container of the present embodiment is a negative pressure generating tube 20 of pipe type. Here, it may be possible to structure the ink tank with which this tube is connected in the same manner as any one of those described in conjunction with the first to fifth embodiments. FIG. 6A is a cross-sectional view which schematically shows the ink supply system as a whole. FIG. 6B is an enlarged sectional view which shows the negative pressure generating tube 20. FIG. 6C is a cross-sectional view of the negative pressure generating tube 20, taken along line 6C—6C in FIG. 6B.

As shown in FIGS. 6A, 6B and 6C, the negative generating tube 20 comprises a housing 21 and an inner walls 22, and it is structured to enable ink to flow inside the inner walls 22. The devise to generate negative pressure is the same as that of each embodiment which has been previously described, that is, it is generated by means of the restoring force of the inner walls 22 to the housing 21 side. The negative pressure generating tube 20 of the present embodiment is arranged in a multiple step. For example, if this negative pressure generating tube 20 is used by coupling each in a tubular form, the entire system repeats curvature along with the scanning of a carriage. With the structure thus arranged, it is possible to generate and maintain negative pressure in the portion which is not bent even in such a case, because the negative pressure tube 20 is formed in a multiple step, thus making it possible to stabilize recording. Also, as compared with the first to fifth embodiments, the negative pressure generating container can be smaller to make the ink jet recording apparatus compact.

It is preferable to configure the sectional surface of the negative pressure generating tube 20 so that the inner bag is collapsed stably. For the present embodiment, the section is made rectangular as shown in FIG. 6C, but it is not necessarily limited to this shape. If only negative pressure can be secured stably, the section may be a parallelogram, a regular oval, an elongated oval, or the like. In this respect, it is of course possible to demonstrate the same effects as those obtainable from the first embodiment.

(Seventh Embodiment)

Figure 7:
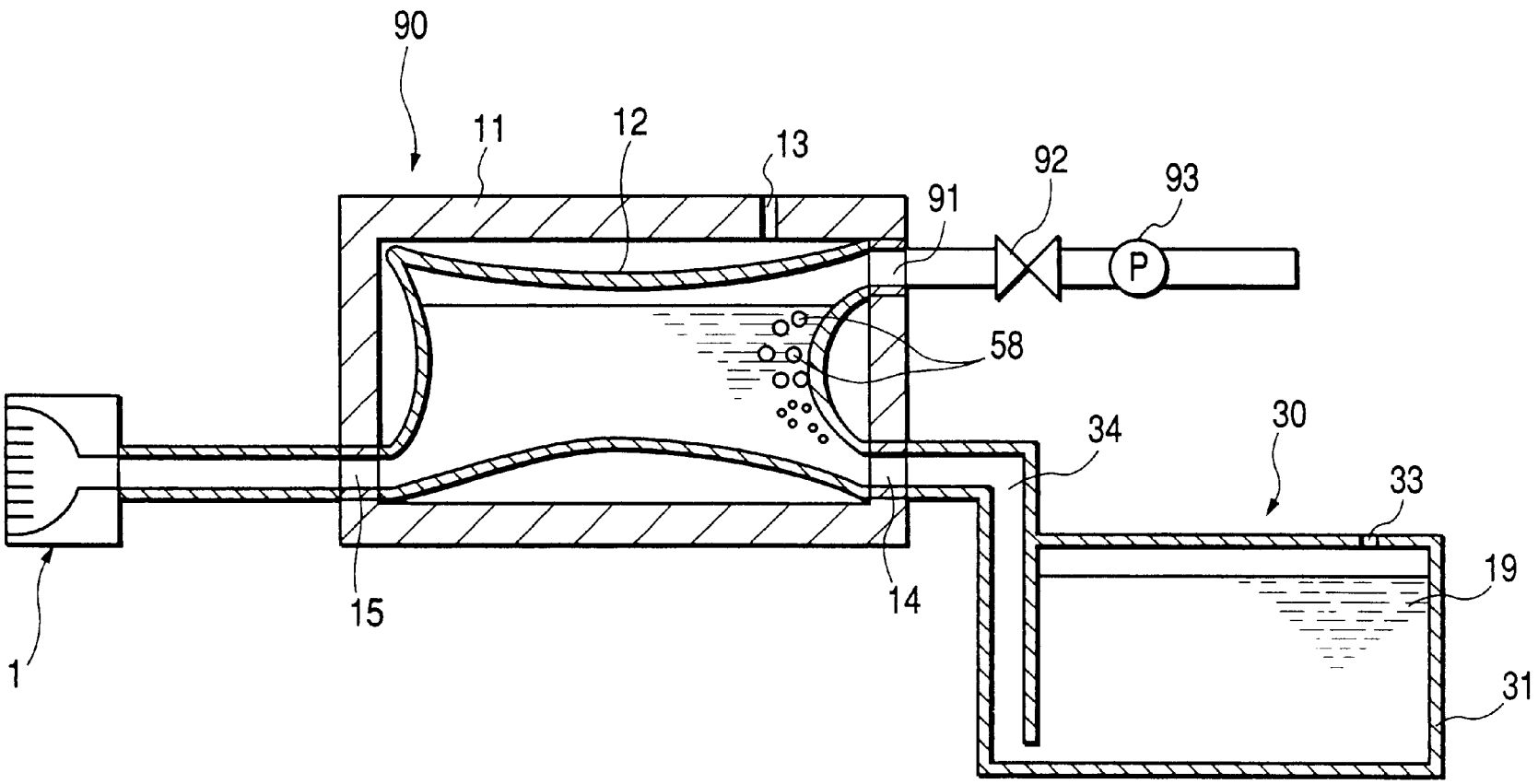
FIG. 7 is a view which schematically shows an ink supply system in accordance with a seventh embodiment of the present invention.

FIG. 7 shows a seventh embodiment. The same reference marks are applied to the same structures as those appearing in each of the embodiments described above, and the description thereof will be omitted. The inner bag 12 of the negative pressure generating container 90 is provided with an air escape port 91 in addition to the ink suction port 14, and ink supply port 15.

For an ink jet recording apparatus, it has been known that ink discharges are disturbed if bubbles exist in ink, and that defective prints may ensue. The air is allowed to enter the ink passage by the gas permeation inside the ink passage or by its entrance form the joint portion when ink tanks are replaced. In accordance with the present embodiment, it is possible to trap the air (bubbles) 58 that enter the passage of ink 19 in the negative pressure generating container 90. The air (bubbles) 58 entering the passage of ink 19 is guided to the negative pressure generating container 58 along the flow of ink 19. Then, the bubbles 58 are trapped upward in the negative pressure generating container 90, thus preventing them from being guided to the ink jet head 1 side. For the air escape port 91, the valve mechanism 92 is provided. The air 58 thus trapped is exhausted by air exhaust means, such as a pump 93, periodically to the outside through the air escape port 91. Hence, the excessive air accumulation is prevented. In this respect, it is of course possible to demonstrate the same effects as those obtainable from the first embodiment.

(Eighth Embodiment)

Figure 8:
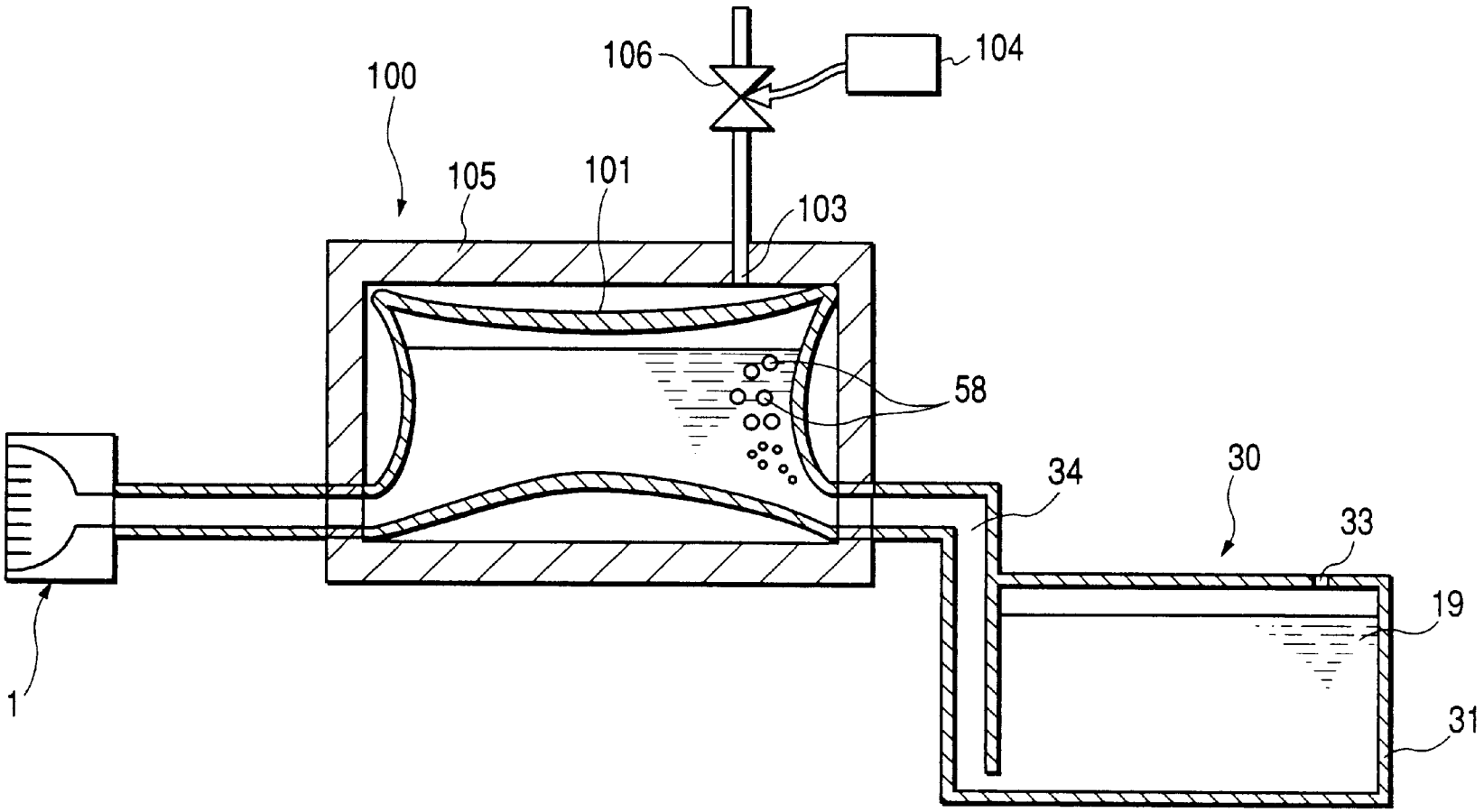
FIG. 8 is a view which schematically shows an ink supply system in accordance with an eighth embodiment of the present invention

FIG. 8 shows an eighth embodiment. The same reference marks are applied to the same structures as those appearing in each of the embodiments described above, and the description thereof will be omitted. In accordance with the present embodiment, pressure generating means 104 is connected with a space between the housing 105 and the inner bag 101 of a negative pressure generating container 100. With the structure thus arranged, it becomes possible to control negative pressure of the ink supply system by both the restoring force of the inner bag 101 and the aforesaid pressure generating means. The characteristics of negative pressure is determined by the thickness of the inner bag 101 or the shape of the negative pressure generating container 100 eventually if the system is effectuated only by means of the restoring force of the inner bag 101. Then, negative pressure becomes higher as ink is consumed (as the inner bag is deformed). However, with the structure of the present embodiment in which pressure generating means 104 is connected with the space between the housing 105 and the inner bag 101, it becomes possible to constantly control negative pressure of the ink supply system even from the initial condition where it is connected with the ink tank until ink is completely consumed by adding pressure to or reducing it from the space between the housing 105 and the inner bag 101 by use of the aforesaid pressure generating means in accordance with the monitored information of the pressure in the ink supply system. This means that the negative pressure exerted on the ink jet head becomes constant at all times, hence making it possible to stabilize ink discharges from the ink jet head for obtaining higher quality prints more reliably.

With the structure arranged as shown in FIG. 8, if the inner bag 101 of the negative pressure generating container 100 is formed by material having higher degree of gas permeability, while making the pressure on the space between the housing 105 and the inner bag 101 lower than the pressure in the inner bag 101 by use of the aforesaid pressure generating means, the air residing in the inner bag is exhausted by the atmospheric difference through the inner bag having high gas permeability. In other words, when the inner bag 101 is formed by material having high gas permeability, the pressure generating means functions essentially as gas-liquid separation means which enables the air residing together with ink in the inner bag 101 to be transmitted (exhausted) to the outside.

Further, as shown in FIG. 8, with the provision of the valve mechanism 106, it becomes possible to switch the connection with the pressure generating means 104 or with the air outside appropriately. In this respect, it is of course possible to obtain the same effects as those obtainable from the first embodiment.

(Ninth Embodiment)

Figure 9:
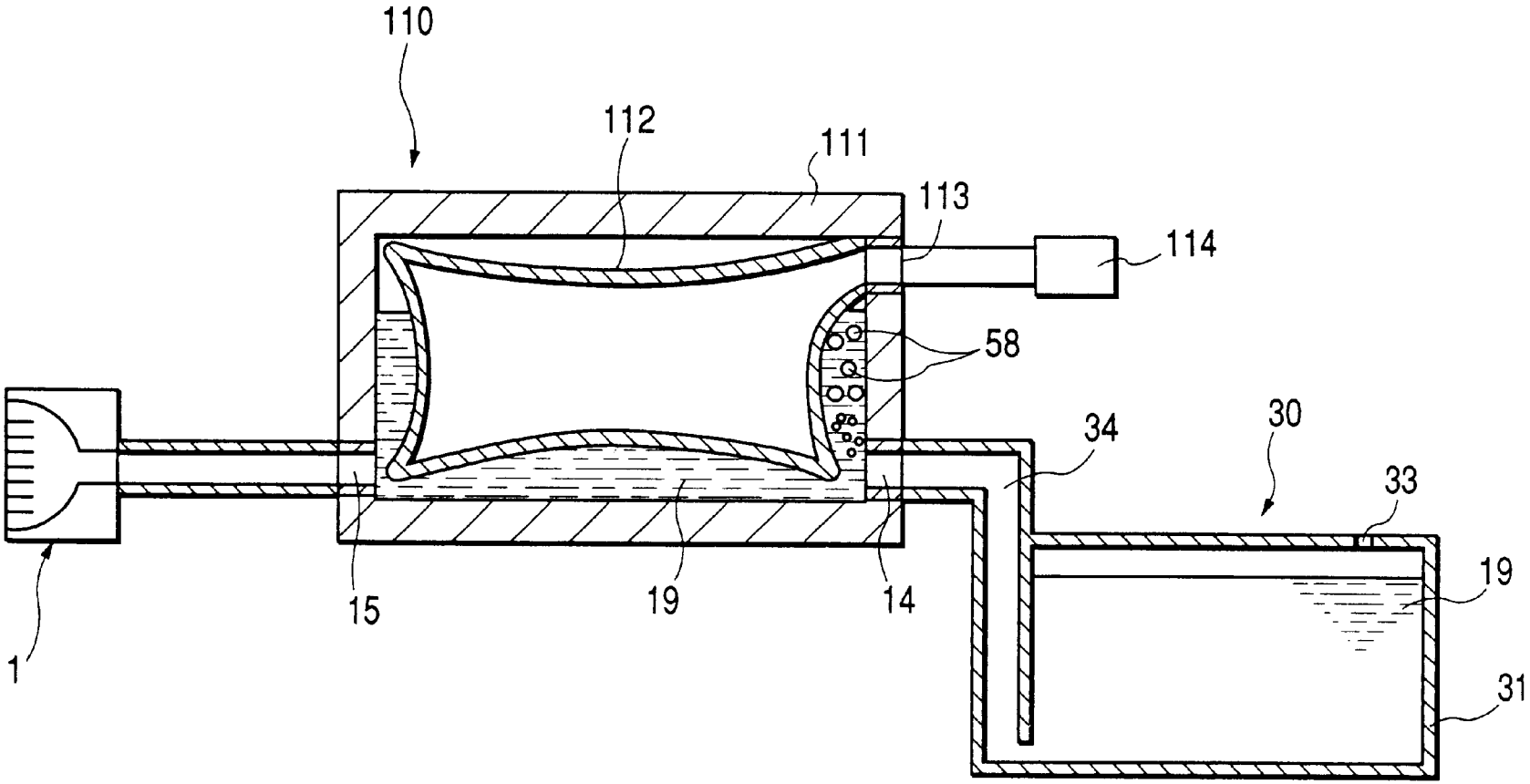
FIG. 9 is a view which schematically shows an ink supply system in accordance with a ninth embodiment of the present invention.

FIG. 9 shows a ninth embodiment. The same reference marks are applied to the same structures as those appearing in each of the embodiments described above, and the description thereof will be omitted. In accordance with the present embodiment, the structure is arranged so that the negative pressure generating container 110 comprises a housing 111, and an inner bag 112 having high gas permeability in the housing 111, but the air is contained in the inner bag 112, and ink 19 is contained in the gap between the housing 111 and the inner bag 112. Therefore, the ink suction port 14 and the ink supply port 15 are connected with the housing 111, and not connected with the inner bag 112. Then, on the contrary, the atmospheric communication port 113 is not connected with the housing 111, but connected with the inner bag 112. With the atmospheric communication port 113, pressure reduction means 114 is connected. When pressure on the space in the inner bag 112 is reduced by this pressure reduction means 114, collapsing force is exerted on the inner bag 112 to generate negative pressure.

The air (bubbles) 58 that enter the passage of ink 19 are guided into the negative pressure generating container 110 along the flow of ink 19 and trapped upward in the space between the housing 111 and the inner bag 112. Then, as described earlier, when the negative pressure is generated in the inner bag 112 by use of the pressure reduction means 114, the bubbles 58 trapped in the space between the housing 111 and the inner bag 112 are permeated and exhausted into the interior of the inner bag 112 having high gas permeability by means of the atmospheric difference. In this respect, it is of course possible to demonstrate the same effects as those obtainable form the first embodiment.

(Tenth Embodiment)

Figure 10:
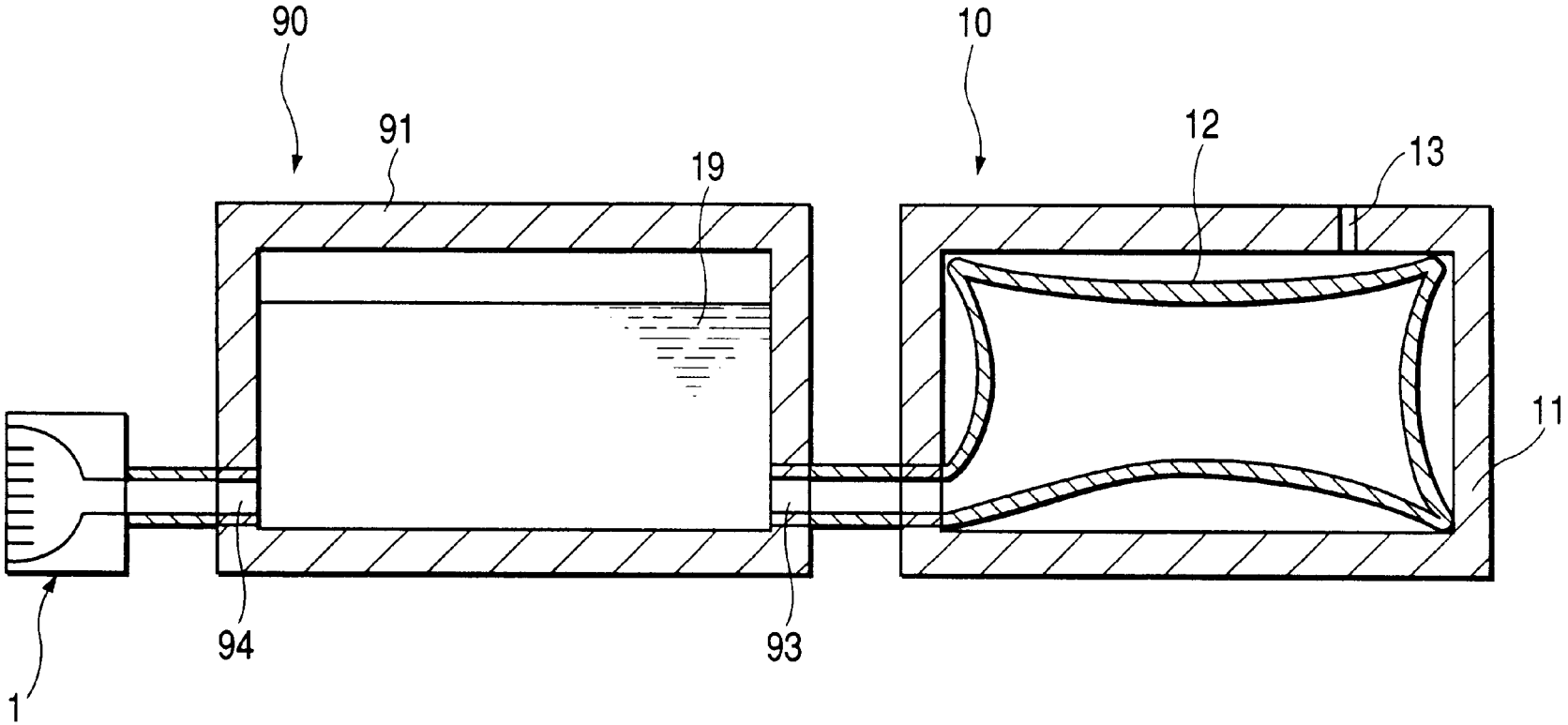
FIG. 10 is a view which schematically shows an ink supply system in accordance with a tenth embodiment of the present invention.

FIG. 10 is a cross-sectional view which shows schematically a tenth embodiment of the present invention. The same reference marks are applied to the same structures as those appearing in the embodiments described above, and the description thereof will be omitted. For the present embodiment, an ink tank 90 is arranged between an ink jet head 1 and a negative pressure generating container 10. The ink tank 90 is contained in a housing 91, which retains ink 19 in the interior thereof. There are provided for a part of housing an ink supply port 94 through which ink is supplied to the ink jet head 1, and a communication port 93 which is communicated with the negative pressure generating container 10 through the communication port 93. The interior of the ink tank 90 is communicated with the interior of the inner bag 12 of the negative pressure generating container 10. The air exists inside the inner bag 12, and then, the structure is arranged to guide the air in the inner bag 12 to the ink tank 90 as the inner bag 12 is collapsed along with the ink consumption. The structure is also arranged so that by means of the restoring force of the inner bag 12, negative pressure is generated in the ink supply system, and when ink in the ink tank 90 is emptied, the ink tank 90 should be replaced. At this juncture, the interior of the negative pressure generating container 12 is released to the air outside. Then, the inner bag 12 returns to the original condition by the restoring force of its own. This operation is repeated whenever a new tank is installed. With the structure thus arranged, the air exists in the negative pressure generating container 10 as in the fifth embodiment described above, hence demonstrating the same effect as the fifth embodiment for the same reason.

(Eleventh Embodiment)

Figure 11:
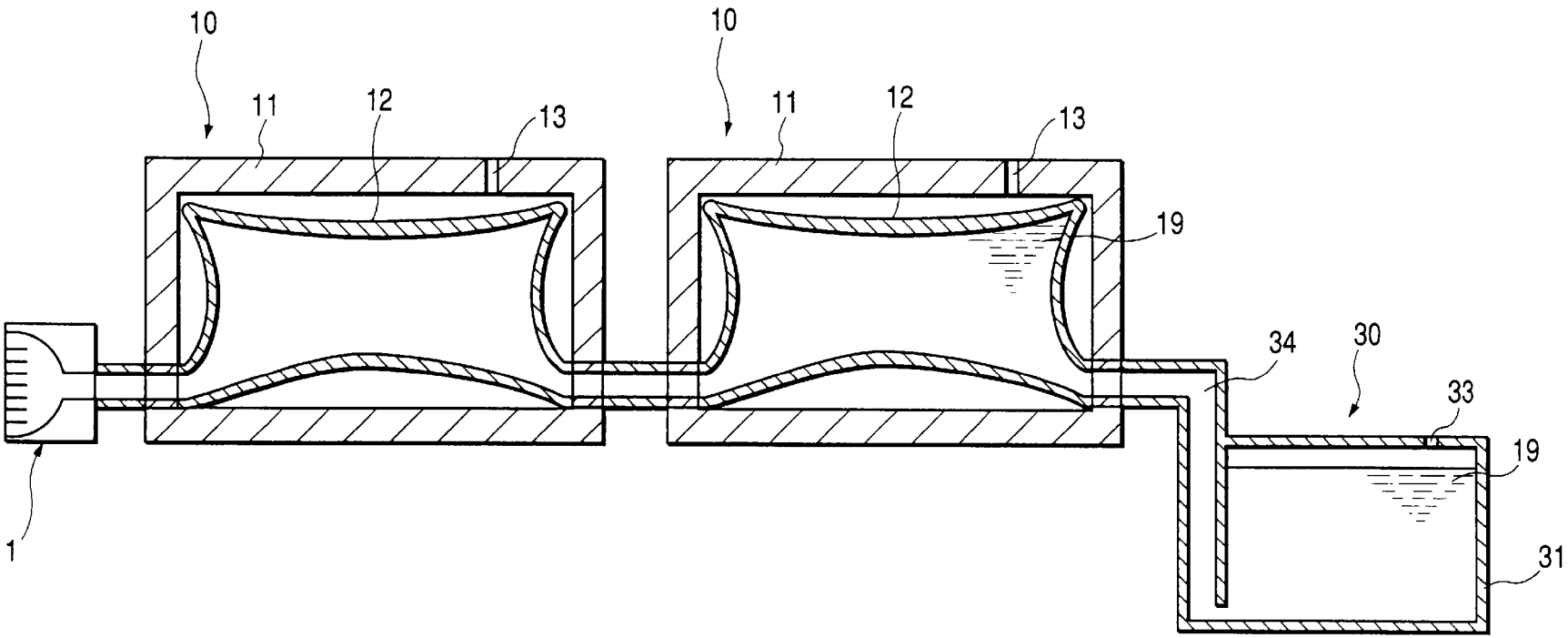
FIG. 11 is a view which schematically shows an ink supply system in accordance with an eleventh embodiment of the present invention.

FIG. 11 is a cross-sectional view which shows schematically a eleventh embodiment in accordance with the present invention. The same reference marks are applied to the same structures as those appearing in the embodiments described above. For the present embodiment, the structure is arranged so that two negative pressure generating containers 10 are arranged between an ink jet head 1 and an ink tank 30. As the mechanism to generate negative pressure is the same as that of each of the other embodiments, the description thereof will be omitted. The following is the effect produced by the structure of the present embodiment. As in the other embodiments, the inner bag 12 is gradually collapsed along with the ink consumption. Then, by the restoring force, negative pressure becomes greater. However, with the two negative pressure generating containers which carry negative pressure, the amount of collapse of the inner bag 12 is a half when the same amount of ink has been consumed as compared with the other embodiments. In other words, when the same amount of ink is consumed by the ink supply system as a whole, the negative pressure becomes smaller as compared with the other embodiments, that is, the changes of negative pressure along with the ink consumption becomes smaller as compared with the other embodiments. Therefore, this structure is more preferable as an ink supply system.

Besides, if the restoring force of the inner bag 12 in either one of the two negative pressure generating containers 10 is made weaker than that of the other inner bag 12, the negative pressure generating container having the weaker restoring force is collapsed earlier along with the ink consumption. In other words, if ink consumption continues after ink in the ink tank 30 is emptied, detection means (not shown) detects the collapsed condition of the inner bag 12 of the negative pressure generating container having the weaker restoring force, hence making it possible to issue alarm in a state where ink still remains sufficiently in the negative pressure generating container the inner bag of which has higher restoring force. In this manner, ink shortage can also be prevented beforehand. For the present embodiment, the description has been made of the example in which two negative pressure generating containers are used. However, the invention is not necessarily limited only to the two containers. It is of course possible to obtain the same effect as described above with the structure having more than two containers.

(Twelfth Embodiment)

Figure 12:
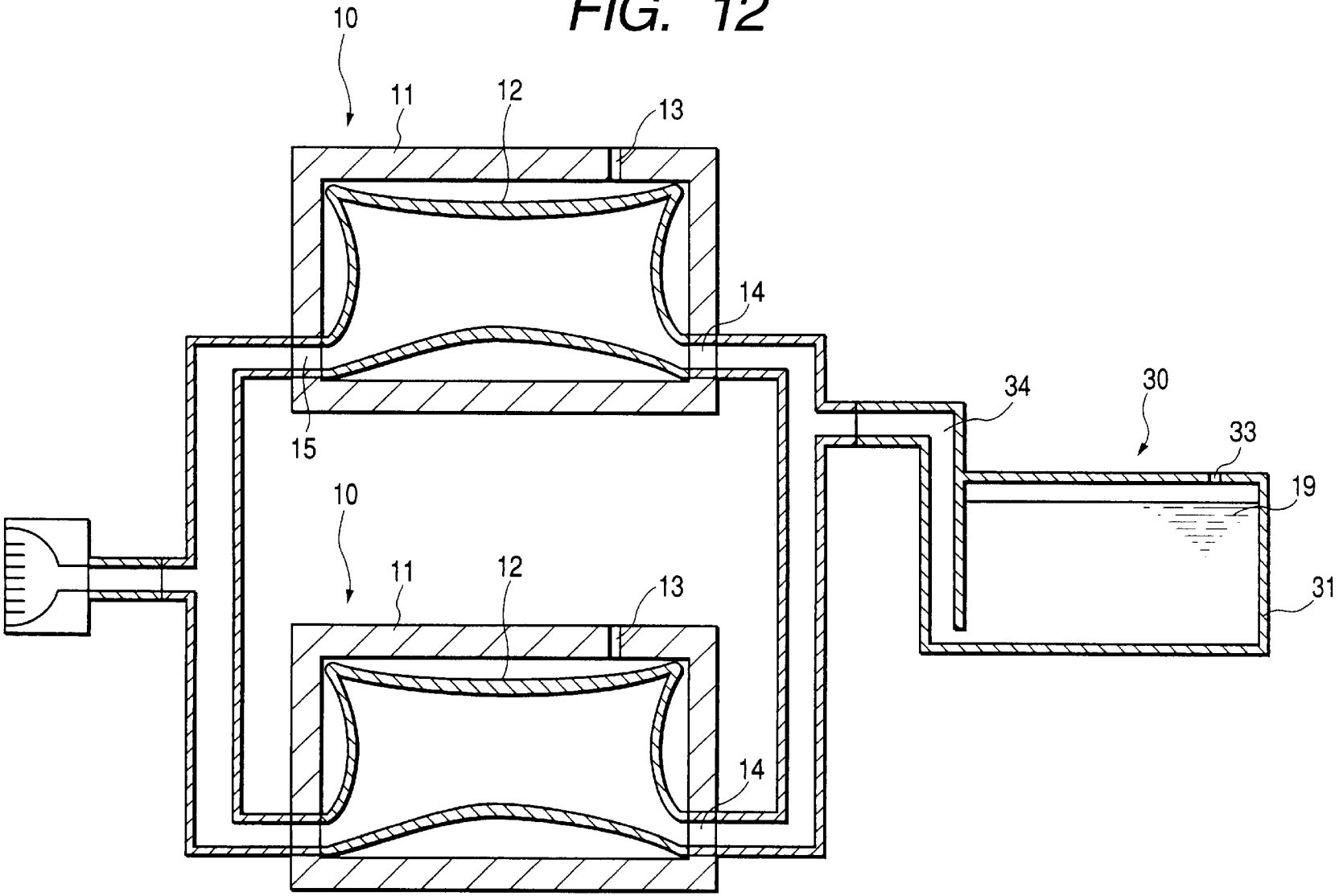
FIG. 12 is a view which schematically shows an ink supply system in accordance with a twelfth embodiment of the present invention.

FIG. 12 is a cross-sectional view which shows schematically a twelfth embodiment in accordance with the present invention. Two negative pressure generating containers 10 are connected in parallel for the present embodiment. All other structures are the same as those of the eleventh embodiment described above. Therefore, the description thereof will be omitted.

In FIG. 12, the two negative pressure generating containers 10 are represented to be arranged up and down for the convenience' sake. Acutally, however, these containers are arranged substantially at the same height.

The present embodiment is essentially equivalent to the eleventh embodiment, hence making it possible to obtain the same effect.

(Others)

Figure 13:
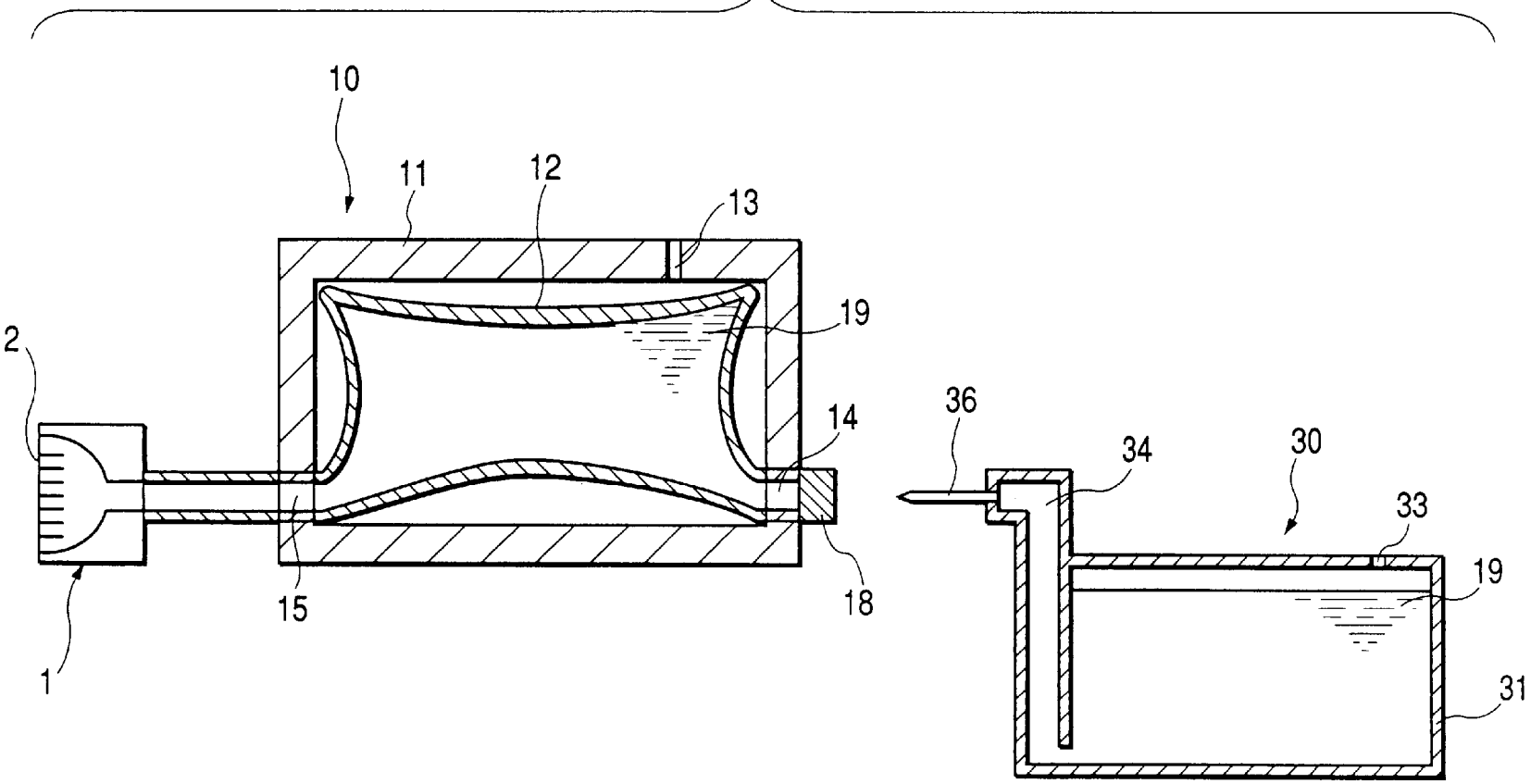
FIG. 13 is a view which schematically shows the variational example of an ink supply system in accordance with the present invention.

In accordance with each of the embodiments described above, it is structured to connect a negative pressure generating container 10 with an ink tank by use of an ink supply tube at all the time. However, a mode is adoptable in which these are connected only when connection is needed. FIG. 13 illustrates a variational example of the kind, which schematically shows the variational example of an ink tank 30 structured to be attachable and detachable in the ink supply system of the first embodiment. A hollow needle 36 is provided for the leading end of the ink supply tube 34 which is connected with the ink supply tube 14 of the negative pressure generating chamber 10 of the ink tank 30. On the other hand, an elastic member 18 is provided for the leading end of the ink suction port 14 of the negative pressure generating chamber 10. Thus, the inner bag 12 of the negative pressure generating container 10 is airtightly closed from the air outside.

Now, the description will be made of the attachment of the ink tank 30 to and its detachment from the negative pressure generating chamber 10. The interior of the inner bag 12 in the ink tank 10 and the interior of the ink tank 30 are communicated when the hollow needle 36 is allowed to penetrate the elastic member 18.

When the ink tank 30 is detached from the negative pressure generating chamber, that is, when the hollow needle 36 is pulled out from the elastic member 18, the hole formed by the penetration of the hollow needle 36 is sealed by the elastic member 18 by the elastic force of its own almost simultaneously. Thus, there is almost no possibility that ink 19 is allowed to leak from the interior of the negative pressure generating container or the inner bag 12 induces the air into it by the negative pressure in the inner bag 12.

The structure of the connecting portion is not necessarily limited to the one described here. It may be possible to adopt any type of structures if only the interior of the negative pressure generating container 10 and the interior of the ink tank 30 can be communicated, while preventing ink leakage and the induction of unwanted air into the ink supply system.

In accordance with the present invention, it is possible to perform stable recording, because the fluctuation of flow resistance due to the fluctuation of discharge amount is made smaller, and also, there is almost no fluctuation of pressure along the carriage operation. Therefore, the retaining amount of ink becomes suitably greater for the performance of higher speed printing. Moreover, the replacement of ink tanks is possible, while ink still remains in the negative pressure container, hence making it possible to essentially prevent the complete ink shortage. Also, with the smaller liquid contact area of the member that should be in contact with ink, the range of material selection becomes wider for such member.

With a multiple layer structure of the ink tank formed by the housing and the inner bag, the preventive effect becomes higher against ink leakage. Also, if the ink tank is provided itself with the function of generating negative pressure, the positional restriction imposed upon the ink tank is eliminated to implement the miniaturization of an ink jet recording apparatus, the enhancement of planning freedom and the degree of designing freedom. Also, by means of multiple layer blow molding or the like, it becomes possible to carry out manufacture simply in one molding step at lower costs.

With the provision of two negative pressure generating containers, it is possible to absorb the fluctuation of pressure due to the changes of atmospheric pressure and temperature by making one of them to function as a buffer tank, thus suppressing the influence that may be exerted on the ink discharges.

If the negative pressure generating container is formed by a cylindrical housing and deformable inner walls, the entire body of an ink jet recording apparatus can be made compact.

What is claimed is:

1. An ink supply system comprising:

an ink jet head for discharging ink;

a passage for distributing ink to said ink jet head, said ink jet head being arranged at one end portion of said passage;

an ink tank for retaining ink for supply to said ink jet head, said ink tank being arranged at the other end portion of said passage; and a negative pressure generating container provided along said passage between said ink jet head and said ink tank, said negative pressure generating container being formed by multiple layers including at least an outer layer and an inner bag, wherein the outer layer forms a housing of substantially polyhedral columnar shape, wherein said inner bag is constructed to retain ink therein and is arranged inside said outer layer and is peelable therefrom, and wherein said inner bag is deformable against a restoring force and deforms and peels from the outer layer upon outflow of ink, and generates negative pressure by the restoring force as it is deformed.

2. An ink supply system according to claim 1, wherein said inner bag is formed by material having low gas permeability.

3. An ink supply system according to claim 1, wherein a space is provided for an interface between the outer layer and inner bag, and said space is communicated with air outside by an atmospheric communication port.

4. An ink jet recording apparatus comprising:

an ink supply system according to any one of claims 1, 2, or 3; and carrying means for carrying a recording medium to be recorded thereon by ink ejected from said ink jet head.

* * * * *